United States Patent [19]

Kawai et al.

[11] Patent Number: 4,867,053

[45] Date of Patent: Sep. 19, 1989

[54] STRAPPING BAND GUIDE UNIT IN FULL AUTOMATIC STRAPPING MACHINE

[75] Inventors: Osatomi Kawai, Yokohama; Junji Kikuchi, Kawasaki, both of Japan

[73] Assignee: Strapack Corporation, Tokyo, Japan

[21] Appl. No.: 156,659

[22] Filed: Feb. 17, 1988

[51] Int. Cl.[4] ..... B65B 13/04

[52] U.S. Cl. ..... 100/26; 100/8; 100/29; 53/589

[58] Field of Search ..... 100/8, 26, 27, 28, 29, 100/32, 33 R, 33 PB; 53/399, 582, 589, 590

[56] References Cited

U.S. PATENT DOCUMENTS

| | | | |
|---|---|---|---|
| 1,056,087 | 3/1913 | Clark | 100/29 X |
| 2,356,904 | 8/1944 | Workman | 100/29 X |
| 2,959,118 | 11/1960 | Hager | 100/29 X |
| 3,019,577 | 2/1962 | Slamar et al. | 100/26 UX |
| 3,269,300 | 8/1966 | Billett et al. | 100/8 |
| 3,315,592 | 4/1967 | Lems | 100/26 X |
| 3,320,874 | 5/1967 | Gasper et al. | 100/26 X |
| 3,613,557 | 10/1971 | Coleman | 100/26 |
| 3,759,169 | 9/1973 | Goodley | 100/29 |

FOREIGN PATENT DOCUMENTS

| | | | |
|---|---|---|---|
| 76908 | 4/1983 | European Pat. Off. | 100/26 |
| 62-4489 | 2/1987 | Japan . | |
| 910167 | 11/1962 | United Kingdom | 100/26 |
| 2038762 | 7/1980 | United Kingdom | 100/29 |

*Primary Examiner*—Philip R. Coe
*Assistant Examiner*—Stephen F. Gerrity
*Attorney, Agent, or Firm*—Burns, Doane, Swecker & Mathis

[57] ABSTRACT

An automatic strapping machine applies a band around object. Application of the band is achieved by retracting a band from a U-shaped arch surrounding the object. A slidable guide bar unit is mounted on the arch for movement toward and away from the object. The guide bar unit includes a guide passage which receives and guides the band as the band travels toward the object.

6 Claims, 6 Drawing Sheets

STRAPPING BAND GUIDE UNIT IN FULL AUTOMATIC STRAPPING MACHINE

FIELD OF THE INVENTION AND RELATED ART

The present invention relates to automatic strapping machines which apply a band around objects, and in particular, to a band guide unit used for guiding a band retracted from a band guiding arch.

FIG. 7 is a side view of the general structure of a conventional horizontal arch-type strapping machine of the fully automatic variety. A main body 1A is mounted on a base 4A and is capable of vertical movement by means of a carrier chain 3A which travels around upper and lower sprockets on a frame 2. A band guiding arch 5A which is capable of vertical movement and which is composed of three sides forming a U-shape extends horizontally from the main body 1A. A driving take-up mechanism connected to a chain sprocket causes the arch to move up or down, together with the main body 1A, from one to several steps, such that the arch can extend around an object 8A to be strapped. A conventional mechanism such as that disclosed in U.S. Pat. Nos. 3,269,300 and 3,579,169 is mounted in the main body 1. That mechanism feeds a band through a bandway in the arch so that the band forms a loop extending around the object 8. After the leading end of the fed band has been fixedly gripped, the band is retracted from the arch and is wrapped and tightened against the object, by means of a band-retracting and tightening mechanism. The leading end of the band is kept fixed to maintain the tightened condition of the band against the object and is then cut. Portions of the band are then fused by means of a fusing mechanism. The object 8A, which can be carried on a conveyor 7A, is strapped by one or several bands applied by repetitions of the above process. The main body 1 and the arch 5A are finally elevated to enable the object to be transferred from beneath the arch 5A by means of the conveyor 7A.

When the strapping band is retracted from the bandway, it pushes and opens a flap which normally closes the band-exiting side of the bandway. In this way, the band departs from the arch 5A and winds around the object. In this case, the band which departed from the arch is caused to wind around the object 8A while gravitating downwardly to some degree because of the horizontal orientation of the arch. Accordingly, the band cannot be wound around the object in a true horizontal plane, thereby rendering sufficient tightening and accurate adherence of the band to the object impossible to achieve. The larger the inside dimensions of the arch and the smaller the outside dimensions of the object, the more remarkable this undesirable phenomenon becomes.

Furthermore, when the outer surfaces of the object are in the vicinity of the bandway, the band rushes out from the arch and is applied quickly and with strong friction against the external surfaces of the object, especially at the corners of a rectangular object, or against a material of high frictional coefficient. Accordingly, due to the high friction, the leading end of the fed band cannot travel quickly enough and may end up hanging loosely from the arch. In this case, poor operation efficiency is caused because the band cannot be wound accurately around the object, requiring restrapping. In addition, great loss from the standpoint of time and economy has arisen on account of the necessity of applying extra bands to the object to compensate for such a shortcoming.

Because this disadvantage results from the relationship between the inside dimensions of the arch and the outside dimensions of the object, the disadvantage occurs in a standard vertical-type full automatic strapping machine in which the band guiding arch extends vertically from the horizontal upper surface of the main body thereof, as well as in a horizontal-type full automatic strapping machine in which the band guiding arch extends horizontally from the vertical side of the main body thereof.

In order to solve the above-described disadvantages in conventional horizontal arch-type full automatic strapping apparatus, the applicant has disclosed an apparatus for preventing the gravity induced fall of a strapping band in Japanese Utility Model Application No. 1,696,673 (Japanese Laid-Open Utility Model No. 4489/1987). That apparatus will now be briefly described in connection with FIG. 6 herein. As shown in FIG. 6, a horizontal-type full automatic strapping apparatus has a band guiding arch 5B extending horizontally from the main body 1B, the latter including mechanisms for feeding, tightening, fusing, and cutting of the strapping band. One end of a crank 11B is secured to the front end of a shaft 10B which constitutes the actuating rod of a rotary solenoid 9B. The latter is fixed by a bracket 17B to the lower portion of the arch in the vicinity of a corner. A connective rod 12B is slidably supported upon a roller 15B which is pivotally mounted on an adapter 16B. One end of the rod is pivotally attached by a pin 13B to another end of the crank 11B. Another end of the connective rod is pivotally mounted by a pin 13B intermediate the ends of a pivoted bar 14B. The free end of the bar 14B moves horizontally in the direction of the center of the arch and can contact the object. The bar 14B lies at a level below the bandway so that a band leaving the bandway is prevented by the bar 14B from gravitating downwardly to an appreciable extent.

A difficulty has been encountered in that apparatus in that the bar 14B, due to its length, may sag, especially as the inside dimensions of the arch become larger or the outside dimensions of the object become smaller, so that the goods cannot be strapped with the band at an intended position.

OBJECT AND SUMMARY OF THE INVENTION

It is an object of the invention to solve the difficulties of the above-described apparatuses which develop in vertical and horizontal strapping machines. Another object is to prevent poor strapping in horizontal-type machines by horizontally winding a band on an object accurately at any time at the intended position irrespective of the inside dimensions of the arch or the outside dimensions of the object. A further object is to eliminate the need for winding of the band by an unnecessary number of windings to compensate for poor strapping performance.

In the present invention, a guide bar is provided which has a band-guiding passage. The guide bar is movable toward and away from the object being strapped and is arranged such that a band emerging from a guide arch enters the passage and is guided thereby during travel toward the object.

BRIEF DESCRIPTION OF THE DRAWINGS

The objects and advantages of the invention will become apparent from the following detailed description of preferred embodiments thereof in connection with the accompanying drawings, in which like numerals designate like elements, and in which.

DETAILED DESCRIPTION OF PREFERRED EMBODIMENTS OF THE INVENTION

The details of the present invention are described below with reference to embodiments involving horizontal and vertical strapping machines.

Figure 4A:
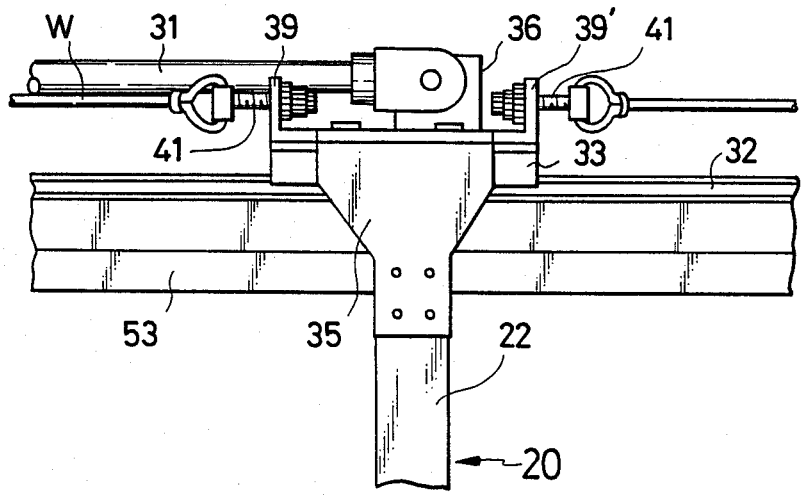
FIG. 4A is a fragmentary plan view of one end of a guide bar unit of the first embodiment.
Figure 4B:
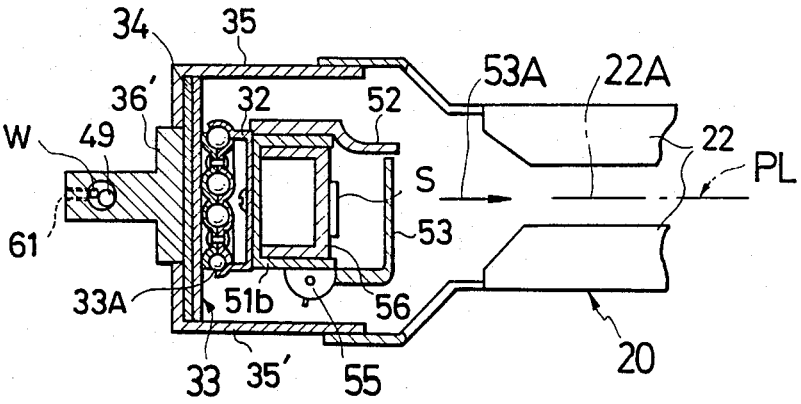
FIG. 4B is a cross-sectional view taken along a vertical plane through a side of the guide bar unit opposite the side depicted in FIG. 4A, relative to the first embodiment.
Figure 5:
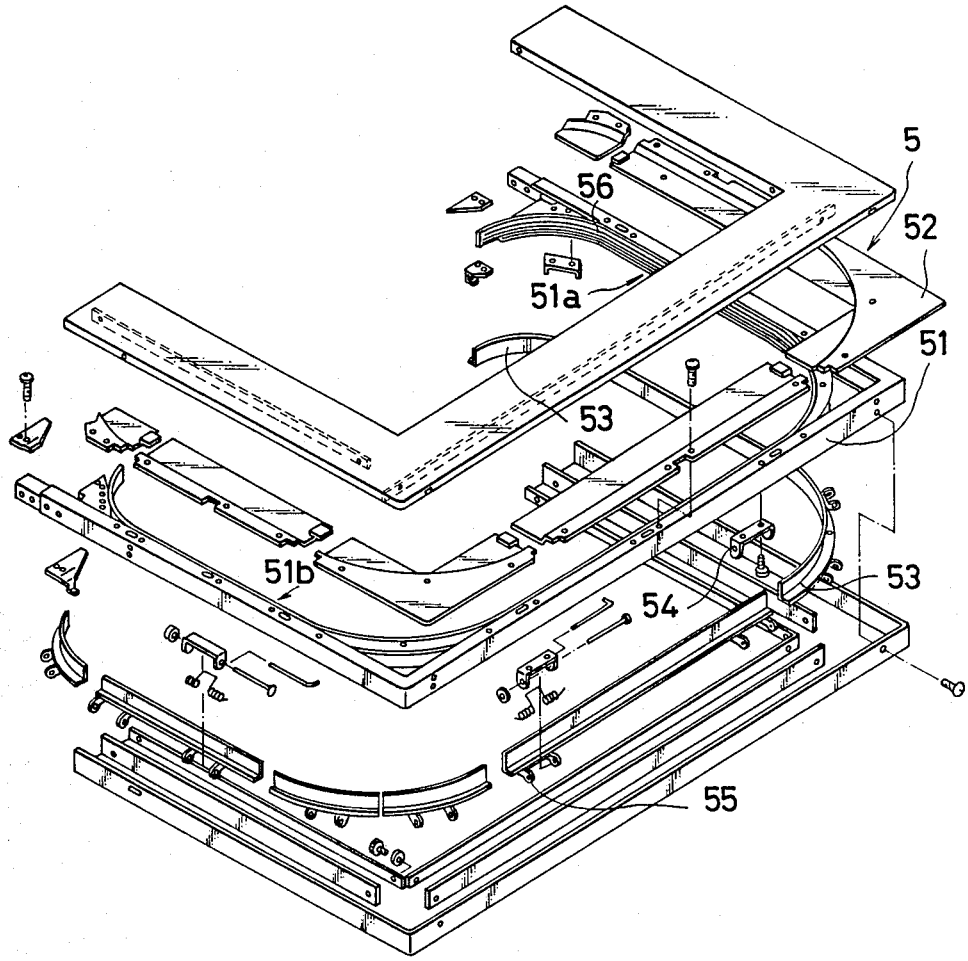
FIG. 5 is an exploded perspective view of a band guiding arch of the first embodiment, and which also can be used in the second and third embodiments.
Figure 6:
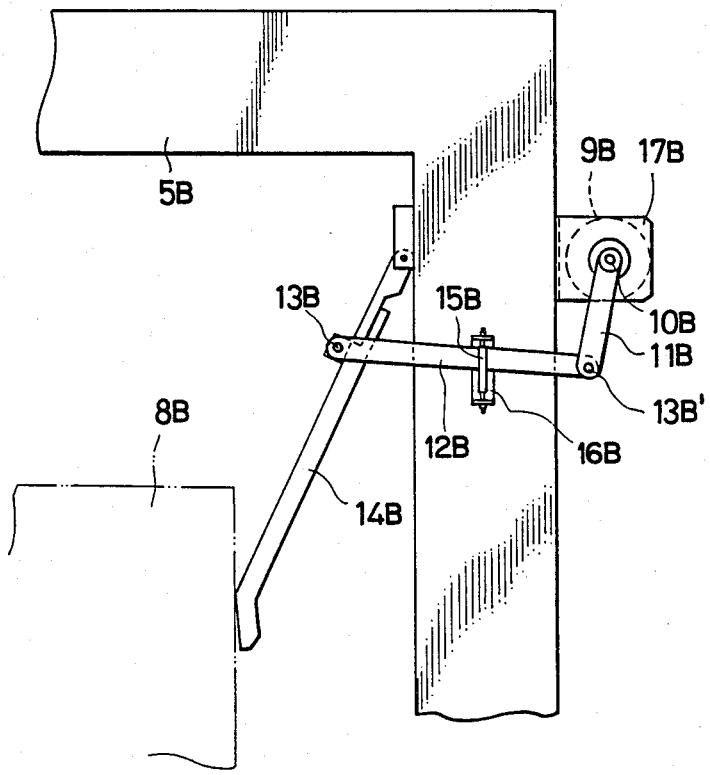
FIG. 6 PRIOR ART
FIG. 6 is a convention band guiding fragmentary plan view of a mechanism.
Figure 7:
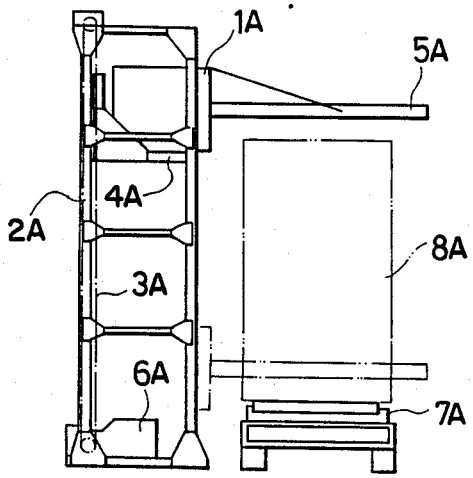
FIG. 7 PRIOR ART
FIG. 7 is a side elevational view of a conventional vertical type strapping machine.

With reference to FIGS. 1, 2, 4A, 4B and 5, a first embodiment of the invention is depicted which includes a main body 1 containing a conventional mechanism for feeding and gripping a strapping band. A band guiding arch 5 is mounted on and extends horizontally from the main body 1. A bandway 56 is provided in the inner surface of a U-shaped arch frame 51 of the arch 5 (FIG. 5). A flap 53 has been divided into a plural number of sections and mounted for upward swinging movement by means of hinges 54 and 55. The flap 53 covers the inside surface of the bandway 56 facing toward the center of the arch (see FIG. 4B). The upper side of the bandway 56 is covered by a fixed plate 52.

Figure 2:
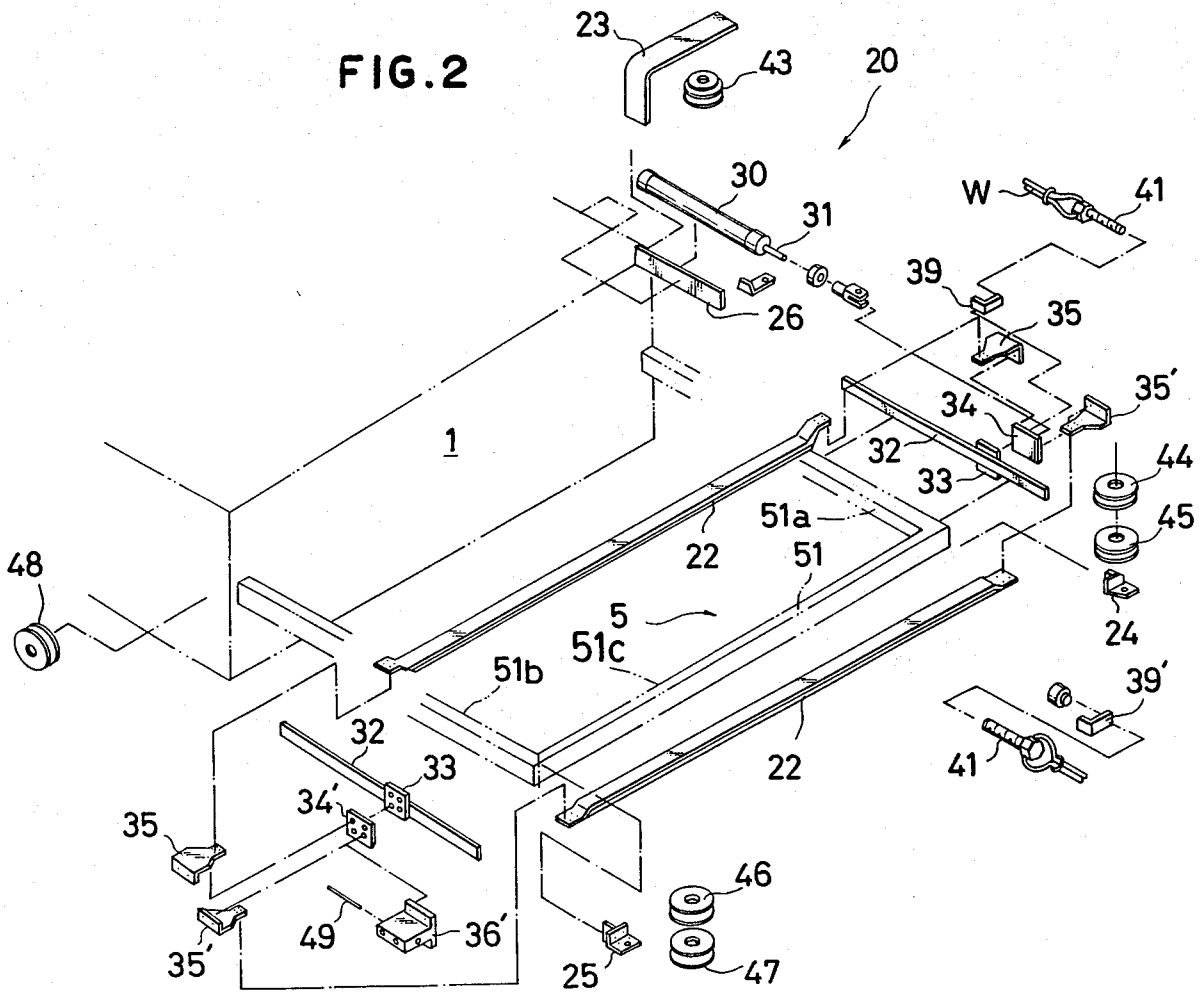
FIG. 2 is an exploded perspective view of a guide assembly according to the first embodiment.

A guide unit 20 guides a strapping band toward the side of an object to be strapped when the band is released from the bandway 56. The guide unit includes slides 33 which, as shown in FIGS. 2, 4A and 4B, are slidably fitted by bearings 33A to slide rails 32, the latter being secured to the outer surfaces of left and right sides 51*a* and 51*b* of the arch frame 51. Reinforcing metal fittings 34, 34' are attached to the slides 33. Pairs of upper and lower L-shaped support plates 35, 35' are fixed to the metal fittings 34, 34' and to opposite ends of a pair of upper and lower rectangular, light, metal guide bars 22 of U-shaped or rectangular cross-section. The guide bars 22 extend from one side 51*a* to the other side 51*b* of the arch frame 51 and are spaced apart vertically above and below a plane PL defined by the bond way to define therebetween a guide passage 22A for accommodating travel of a released band. Thus, as shown in FIG. 4A, the passage 22A is open toward both the main body 1 and the end portion of the bandway defined by end section 52C of the frame 51 (see FIG. 2).

The front end of a rod 31 of an air cylinder 30 is connected to a flange 36 fixed to one reinforcing metal fitting 34, whereas a flange 36' is secured on the other fitting 34'.

L-shaped brackets 39 and 39' are mounted on the fitting 34, and opposite ends of a wire W are secured to those brackets 39, 39' by attaching bolts 41. The wire W extends around all three sides of the arch frame 51.

Figure 1:
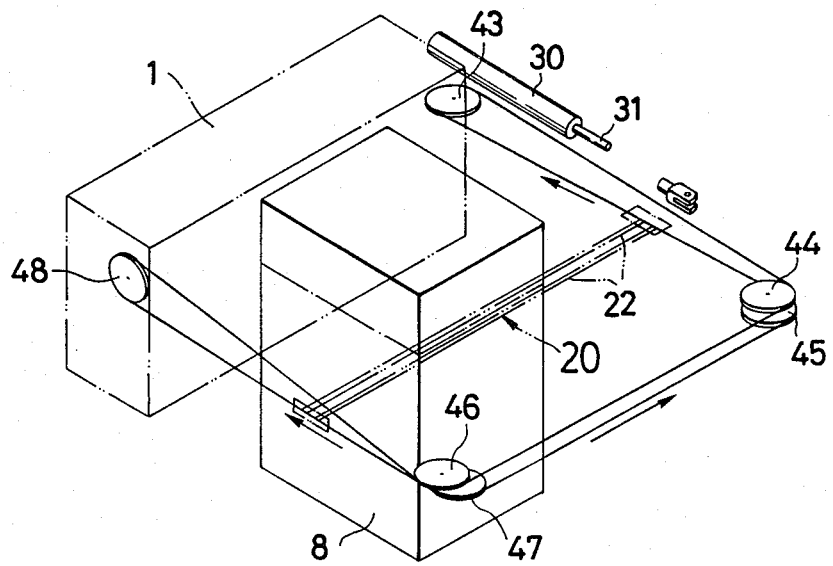
FIG. 1 is a schematic perspective view of a first embodiment of the invention in a horizontal-type strapping machine.

As shown in FIGS. 1 and 2, the wire W extends from the bracket 39 and travels around a pulley 43 rotatably attached to a bracket 23 which is fixed to the main body 1 with its axle directed vertically. The wire is further wound around one pulley 44 of two pulleys 44 and 45 rotatably attached to a bracket 25 which is fixed to the upper surface of the right corner of the arch frame 51. The axle of those pulleys 44, 45 are oriented vertically. The wire W is then wound around one pulley 46 of two pulleys 46 and 47 supported by a bracket 25 which is fixed to upper surface of the left corner of the arch frame 51. The axles of those pulleys 46, 47 are oriented vertically. The wire is subsequently reversed around a pulley 48 which is attached to the left side of the main body 1 with its axle oriented horizontally. The wire passes through a hole provided on a projection of the flange 36' (see FIG. 4B) and is wound successively around pulleys 47 and 45, and finally is secured to the other bracket 39'.

The wire is affixed to the flange 36'by a fixing pin 49 and a screw 61 as depicted in FIG. 4B.

The operation of the machine depicted in FIGS. 1, 2, 4A, 4B, and 5 is described below. When the rod 31 is fully extended, the guide bars are located farthest from the main body 1. When the conveyor 7 transfers an object 8 to a location beneath the arch, the guide 5 is lowered along with the main body 1. When a limit switch (not shown) on the main body 1 is brought into contact with the object 8, downward movement of the main body 1 is halted, and the air cylinder 30 retracts the rod 31 for a period set by a timer, whereby the wire W is moved in the direction of the arrow in FIG. 1 to displace the guide bars 22 toward the object 8 until the guide bars 22 contact the object 8. A relief valve can be provided to prevent damage to the air cylinder 30 when this occurs. Upon completion of the time set by the timer, the band retracting mechanism in the main body 1 acts to retract the band, whereupon the flap 53 is swung open to permit egress of the band.

Because the passage 22A receives and guides the released band S (traveling in the direction of arrow 53A in FIG. 4B), the released band is wound around the object 8 while guided by the guide bars 22. After the band has been wrapped around the object 8, the air cylinder 30 extends the rod 31 so that the guide bars 22 are separated from the object 8 and move to their position farthest from the main body 1. Meanwhile, the conventional mechanism in the body 1 for fusing together the ends of the band and for cutting the band is actuated. Thereafter, a new band section is fed into the arch 5, in preparation of the next strapping operation.

Figure 3:
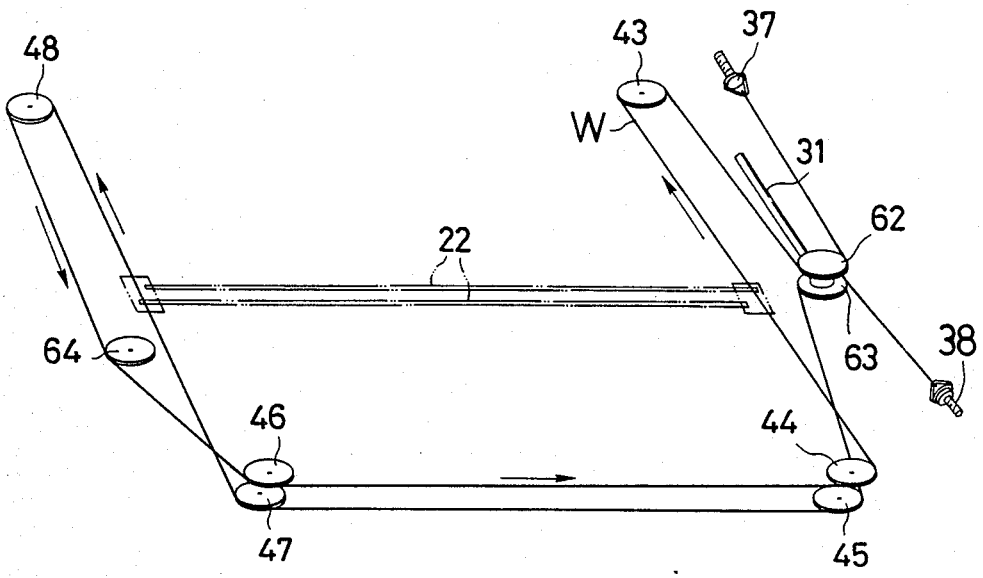
FIG. 3 is a schematic perspective view of a second embodiment of the invention which constitutes a modification in the wire system of the first embodiment.

FIG. 3 illustrates another embodiment of the present invention, in which two pulleys 62 and 63 are connected to the front end of the air cylinder rod 31. One end of the wire W is fixed to a side of the frame 51 by an attaching bolt 38 in the vicinity of one corner of the arch frame 51, and the other wire end is attached to the same side of the frame 51 closer to the main body 1 by a bolt 37. The wire extends from the bolt 37 and then turns back around pulley 62 and travels to the pulley 43 mounted on one side of the main body. The wire turns around on the pulley 43 and then extends around the pulleys 44 and 46. The wire then turns around a pulley 48 mounted on the other side of the main body. The wire then travels against a tension pulley 64 and extends around pulleys 47 and 45 before turning back around pulley 63 and being attached to the attaching bolt 38. The remaining structure is the same as described in the foregoing embodiment. The air cylinder 31 is fixed to the side of the main body 1 by means of a bracket 26 and is connected to an air-feeding mechanism (not shown).

The difference of the action of the embodiment depicted in FIG. 3 from that of the earlier described embodiment is described below. When the rod 31 is extended from its retracted position in order to accommodate an object 8, the wire W around the pulley 62 at the front end of the rod 31 is stretched and the wire W around the pulley 63 is loosened. The advantage is that the guide bars 22 move by a length twice the distance that the rod 31 is moved.

Figure 4C:
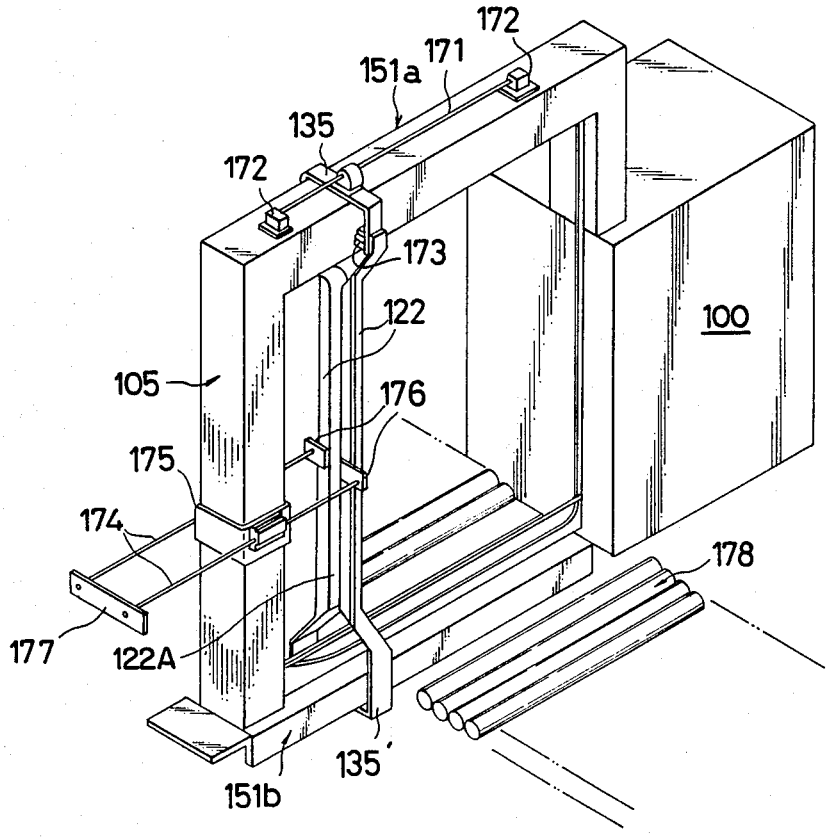
FIG. 4C is a perspective view of a third embodiment of the invention involving a vertical type of strapping machine.

FIG. 4C depicts yet another embodiment of the present invention, in which the present invention is applied to a so-called vertical-type strapping machine 100. Guide bars 122 are slidably mounted on the vertically spaced sides 151*a* and 151*b* of a band guiding arch 105, by means of upper and lower U-shaped support plates 135, 135' A pair of blocks 172 is mounted on the arch 105 and the ends of a guide pole 171 are mounted in the blocks. The upper support plate 135 is slidably mounted on the pole 171.

Guide rollers 173 (only one depicted) are rotatably supported on the opposing inner surfaces of the upper support plate 135 in slidable contact with both side surfaces of the side 151*a* of the arch 105. Similar guide rollers (not shown) are mounted on the lower support plate 135'. The guide bars 122 face the bandways disposed along the opposing upper and lower sides 151*a* and 151*b* of the band guiding arch and define a passage 122A for guiding the band n the manner described earlier herein. The guide bars 122 are so mounted as to be capable of free reciprocation toward or away from the object to be strapped which is advanced along a roller conveyor 178. Two sliding rods 174 are slidably supported in bearings 175 attached to the bight portion of the arch between the opposing upper and lower sides 151*a*, 151*b*. The front ends of the rods 174 are fixed to the guide bars 122 by means of brackets 176, and the rear ends thereof are provided with a manually actuable handle 177.

In operation, the handle 177 is pressed so that the guide bars 122 are pushed against the object to be strapped which rests on the roller conveyor 178. Then, a starting button is turned ON, whereupon the front end of the band is grasped to start the band retracting and tightening processes during which the band is guided by the passage 122A. After completion of the tightening and fusing process, a new section of the band is fed into the arch 105, and the guide bars 122 are retracted, i.e., moved to the left in FIG. 4C, by pulling on the handle 177.

What is claimed is:

1. In an automatic strapping machine comprising a main body and a band guiding arch extending from said body; said arch including two parallel side portions interconnected by an end portion, said side and end portions defining side and end portions, respectively, of a bandway which opens toward a center of said arch; said main body including means for feeding a strapping band through said bandway, retracting the band from said bandway and tightening the band around an object to be strapped, fusing together a pair of band sections, and cutting the fused band; the improvement comprising guide bar means extending across said arch from one said arch side portion to the other said arch side portion, said guide bar means disposed intermediate said main body and said arch end portion and being slidable relative to said arch so as to be movable toward and away from said main body and said arch end portion, said guide bar means including first and second guide bars forming therebetween a band guiding passage having a length extending substantially perpendicular to said bandway side portions, said guide bars being spaced apart throughout said length and separated by a plane defined by said bandway such that said passage is open at its opposite ends toward said bandway side portions, and said passage is open along its length toward said bandway end portion and toward said main body, such that a band emerging from said bandway side portions enters said opposite ends of said passage and is guided within said passage as it travels toward the object.

2. In an automatic strapping machine according to claim 1 wherein said arch is oriented in a horizontal plane.

3. In an automatic strapping machine according to claim 1 wherein said arch is oriented in a vertical plane.

4. In an automatic strapping machine according to claim 1 wherein opposite ends of said guide bar means carry slides slidably mounted on said side portions.

5. In an automatic strapping machine according to claim 1 including a fluid cylinder preferably connected to one end of said guide bar means for displacing said guide bar means toward and away from said body, and a wire extending around said arch on pulleys carried by said arch, said wire interconnecting opposite ends of said guide bar means for effecting common movement of said ends.

6. In an automatic strapping machine according to claim 1 wherein said guide bar means is mounted for free sliding movement on said side portions of said arch.

* * * * *